US006088880A

United States Patent [19]

LaSee

[11] Patent Number: 6,088,880

[45] Date of Patent: Jul. 18, 2000

[54] ADJUSTABLE SHOE FOR AWNING WINDOW HINGE

[76] Inventor: Jack LaSee, 308 W. Cedar St., Abbotsford, Wis. 54405

[21] Appl. No.: 08/888,725

[22] Filed: Jul. 7, 1997

[51] Int. Cl.[7] ..... E05D 3/06; E05D 13/00

[52] U.S. Cl. ..... 16/366; 16/362; 16/193; 49/181

[58] Field of Search ..... 16/193, 338, 341, 16/362, 368, 366, 370, DIG. 16; 49/176, 177, 181

[56] References Cited

U.S. PATENT DOCUMENTS

| | | | |
|---|---|---|---|
| 3,184,784 | 5/1965 | Peters | 16/193 |
| 3,650,070 | 3/1972 | Ringle, III | 49/251 |
| 3,788,006 | 1/1974 | Teggelaar et al. | 16/193 |
| 4,363,190 | 12/1982 | Anderson | 49/181 |
| 4,833,754 | 5/1989 | Yang | 16/339 |
| 5,210,976 | 5/1993 | Cripps | 49/181 |
| 5,560,084 | 10/1996 | Baker | 16/193 |
| 5,613,277 | 3/1997 | Dallmann et al. | 16/368 |

*Primary Examiner*—Chuck Mah
*Attorney, Agent, or Firm*—Quarles & Brady

[57] ABSTRACT

A sliding shoe portion of a awning window hinge includes a cantilevered rail fitting within a channel of a track on which the shoe slides. A wedge screw placed between the fulcrum of the cantilevered portion and its open end deforms the rail to control the clearance between the rail and channel. The wedge screw may be displaced toward one longitudinal end of the shoe allowing its access when the awning hinge is assembled to a window and window frame with attached operator.

7 Claims, 1 Drawing Sheet

ADJUSTABLE SHOE FOR AWNING WINDOW HINGE

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to awning window hinges and in particular to a sliding shoe used in awning window hinges, the shoe providing adjustable clearance and friction in its engagement with a hinge track.

Awning window hinges provide for the pivotal opening of a window about a horizontal axis through the use of left and right awning window hinges supporting the window sash. A separate operator opens and closes the window, typically through the use of a crank mechanism. The awning window hinges are in the form of a two bar linkage, the first bar being a sash arm attached along the window sash and having one end pivotably attached to one end of a guide arm forming a second bar of the linkage. A remaining end of the guide arm is pivotably attached to a track extending along the window frame. The remaining end of the sash arm is pivotably attached to a shoe sliding along the track.

With this hinge mechanism, the pivot point of the window moves with the shoe as the window opens preventing interference between the window and the window frame.

The shoe is typically held captive on the sliding track by a channel running along a shoe support surface of the track. A ridge of the shoe fits within this channel. The shoe must have sufficient clearance in its fitting with the channel to slide along the channel as the window opens but must not have so much clearance as to wedge within the channel or "chatter" in its movement. A certain degree of friction between the shoe and the channel is also required to stabilize the open window against the forces gravity and the force of wind catching the open window.

The shoe support surface of the track is typically vertical and the channel perpendicular to the shoe support surface to open the shoe support surface. The rail of the shoe, which engages the channel, is therefore generally perpendicular to a shoe plate engaging the shoe support surface of the track. It is known in the prior art to separate the rail from the shoe plate near the center of the shoe and to place in that separation a wedge (typically a screw) producing a bulge at the middle of the rail causing the rail to fit more tightly within the channel. Adjustment of the screw allows adjustment of the fit between the rail and the channel.

The shoe must be constructed of a sturdy material and is typically manufactured of a formed steel sheet surrounded by an injection molded plastic matrix. Accordingly deformation of the rail requires considerable force and adjustment of the shoe is relatively difficult. Further, the adjustment screw tends to be located underneath the sash of the window making it necessary to disconnect the operator from the hinge for adjustment to take place.

BRIEF SUMMARY OF THE INVENTION

The present invention mounts the rail in cantilever fashion from the shoe allowing the rail to be deformed about a single fulcrum much reducing the needed adjustment pressure. In addition the adjustment screw may be placed closer to the edge of the shoe allowing adjustment to be made without interference from the window and without disassembly of the operator and hinge.

Specifically the invention is an adjustable shoe for use with a awning window hinge having a longitudinally extending track with a shoe support surface, the track attachable to a window opening and having a channel extending along the length of the shoe support surface at a transverse edge of the shoe support surface opening perpendicularly to the shoe support surface. The hinge also includes a sash arm attachable to a window sash and a guide arm pivotably attached at one end to the track and at one end to the sash arm.

The shoe includes a sole plate having a first side sized to fit adjacent to the shoe support surface and slide thereon and a pivot mount pivotably receiving one end of the sash arm. A rail extends perpendicularly from the sole plate to fit within the channel when the first side of the sole plate is adjacent to the shoe support surface. The rail is cantilevered to attach at a first end via a fulcrum to the sole plate. A wedge is movably attached to the sole plate and rail and positioned between the fulcrum and a second end of the rail to bend the rail outward from the sole plate reducing clearance between the rail and the channel when the rail is so installed.

Thus it is one object of the invention to provide a shoe for use with a awning window hinge that provides better adjustability. Attaching the rail to the sole plate at a single fulcrum reduces the forces necessary for deformation of the rail.

The wedge may be a tapered screw received at an aperture having one wall on the sole plate and opposed second wall on the rail. The wedge may be positioned at a longitudinal end of the shoe opposite the pivot point.

Thus it is another object of the invention to allow adjustment of the shoe without disassembly of the window and hinge. The present design, by permitting movement of the screw to one longitudinal end of the shoe, allows the screw to remain accessible for adjustment.

The foregoing and other objects and advantages of the invention will appear from the following description. In this description reference is made to the accompanying drawings which form a part hereof and in which there is shown by way of illustration a preferred embodiment of the invention. Such embodiment does not necessarily represent the full scope of the invention however and reference must be made therefore to the claims for interpreting the scope of the invention.

DETAILED DESCRIPTION OF THE INVENTION

Figure 1:
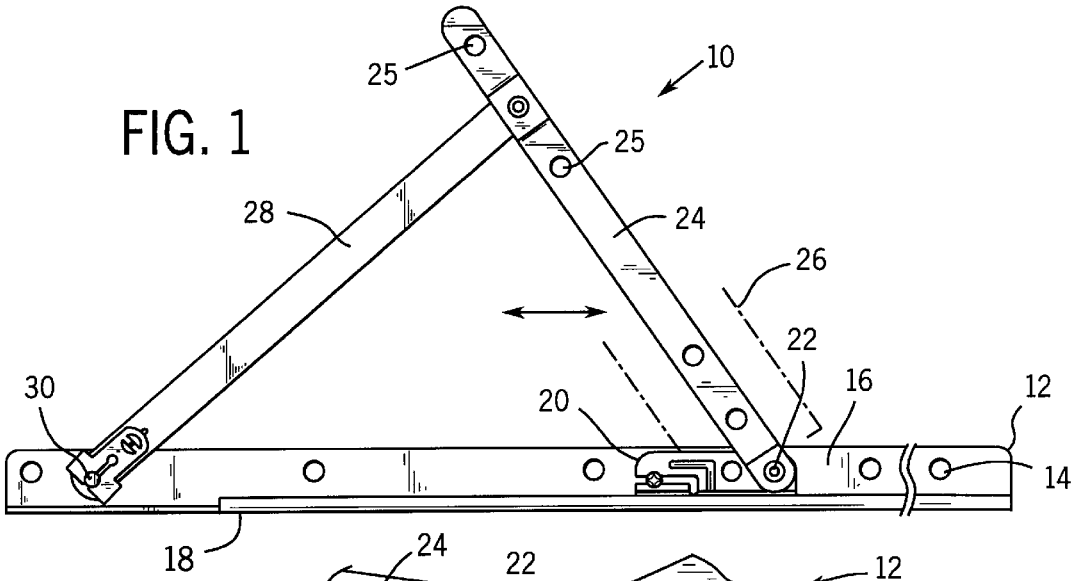
FIG. 1 is a plan view of a lower awning window hinge showing a guide arm pivotably attached to a sash arm and a track, the sash arm, in turn, having one end attached to a shoe slidable along the track.

Referring now to FIG. 1, a awning window hinge 10 includes a longitudinal track 12 such as may be attached to a vertical member of a window frame by mounting holes 14. The track 12 includes a shoe support surface 16 and a perpendicular U-channel 18 (best seen in FIG. 2) attached at one transverse edge of the shoe support surface to open toward the shoe support surface 16.

Traveling along the shoe support surface 16 is a shoe 20 having at one longitudinal edge a pivot point 22 allowing the attachment of one end of a sash arm 24 pivotably to the shoe 20. The sash arm 24 attaches to a sash of a window 26 (shown in dotted line) by screws (not shown) passing through one or more holes 25 cut in the sash arm 24.

The other end of the sash arm 24 is pivotably attached to one end of a guide arm 28. The remaining end of the guide arm 28 is attached to a longitudinal end of the track 12 at a pivot point 30 on shoe support surface 16.

Figure 2:
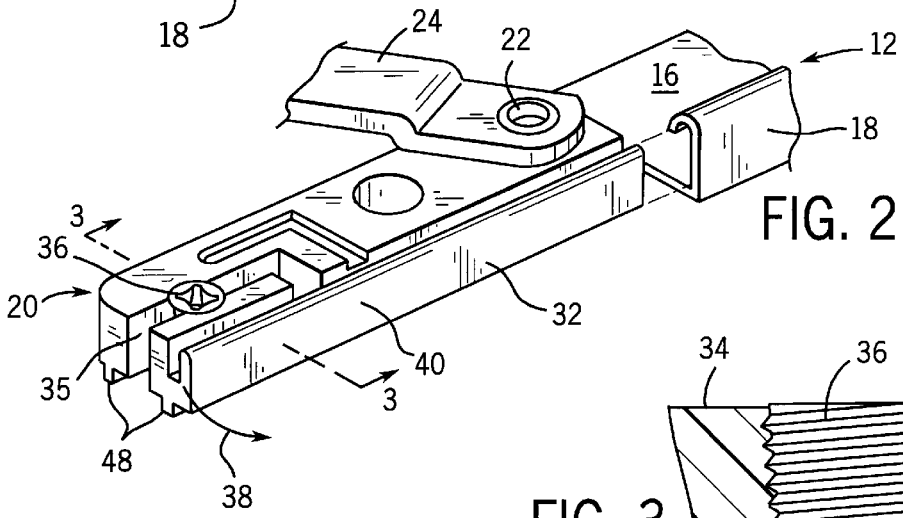
FIG. 2 is a perspective view of the shoe of FIG. 1 with the track cut away showing a screw wedge positioned at one longitudinal end of the shoe to deform a cantilevered section of a rail normally fitting within a channel of the track.
Figure 5:
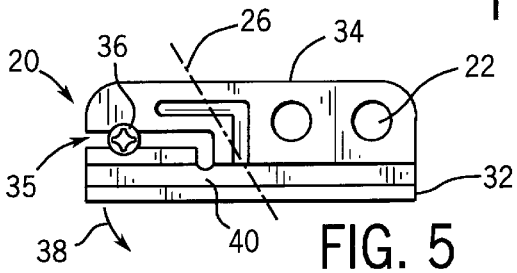
FIG. 5 is a plan view of the shoe of FIG. 2 with the sash arm removed showing deformation of the cantilevered rail.

Referring now to FIG. 2, the shoe 20 includes a rail 32 running along one transverse edge of the shoe 20 and extending away from the shoe support surface 16 to be received within the channel 18. Referring also to FIG. 5 the rail 32 is attached in cantilevered fashion at one end to a sole plate 34, the latter which extends over the shoe support surface 16 when the shoe 20 is installed on track 12. A longitudinally extending notch 35 is thus formed between the remaining end of the rail 32 and the sole plate 34.

Positioned within the notch 35 is a wedge screw 36 that may be driven into the notch 35 along an axis perpendicular to the shoe support surface 16 toward the shoe support surface 16 to flex the rail 32 outward as indicated by arrow 38 around a fulcrum 40, the last point of attachment between the rail 32 and the sole plate 34.

As is seen best in FIG. 5, considerable latitude in the desired mechanical advantage in deformation of the rail 32 may be had by proper placement of the wedge screw 36 with respect to the fulcrum 40. Generally greater mechanical advantage being had as the wedge screw 36 is moved away from fulcrum 40.

Figure 3:
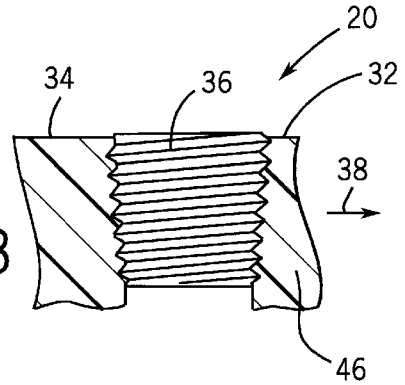
FIG. 3 is a fragmentary cross section taken along lines 3—3 of FIG. 2 showing the tapered configuration of the screw wedge of FIG. 2.

Referring now to FIG. 3 the wedge screw is generally tapered along its axis to fit within a tapered hole formed between the rail 32 and sole plate 34. Thus, as tapered wedge screw 36 is driven into the shoe 20, the wedge screw 36 serves to push the rail 32 outward with respect to the sole plate 34.

Figure 4:
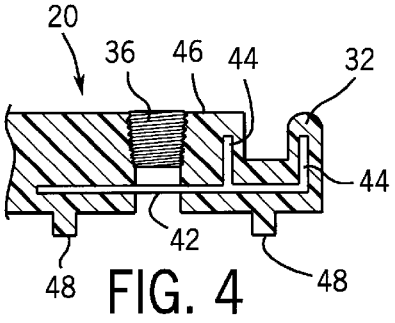
FIG. 4 is a non-fragmentary cross sectional view taken along lines 3—3 of FIG. 2 showing the internal metal spine of the shoe of FIG. 2 and the outer plastic matrix in relationship to the screw wedge of FIG. 2.

Referring now to FIG. 4, the shoe 20 may be formed of a single sheet of metal 42 to have upwardly extending flanges 44 defining the entire length of the rail 32 and a cam portion of the rail 46 contacting one side of the wedge screw 36. This sheet of metal 42 may serve as a spine for injection molded thermoplastic providing the outer dimensions of the shoe 20 and those portions contacting the track 12 and channel 18. The thermoplastic may also provide the tapered hole into which the wedge screw 36 is placed.

The lower surface of the shoe 20 may include longitudinal runners 48 reducing the friction and for jamming from dirt or debris between the shoe 20 and the track 12.

Figure 6:
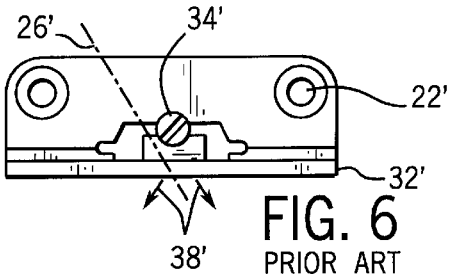
FIG. 6 PRIOR ART
FIG. 6 is a plan view similar to FIG. 5 of a prior art shoe design showing a central deformation of a non-cantilevered rail such as requires additional force and necessitates placement of the adjustment wedge in a central location blocked by the window.

In contrast to the present invention shown in FIG. 5, a prior art shoe shown in FIG. 6 does not provide a cantilevered portion of the rail 32' and thus deforming the rail 32' as indicated by arrows 38' requires substantially greater force. Further, the wedge screw 36' for such deformation must be centrally located and thus obscured by the window 26' which pivots about pivot point 22'.

The above description has been that of a preferred embodiment of the present invention. It will occur to those that practice the art that many modifications may be made without departing from the spirit and scope of the invention. In order to apprise the public of the various embodiments that may fall within the scope of the invention the following claims are made.

I claim:

1. An adjustable shoe for use with a awning window hinge, the hinge having a longitudinally extending track attachable to a window opening, the track including a shoe support surface and a channel extending along the length of the shoe support surface at a transverse edge of the shoe support surface, the channel opening perpendicularly toward the shoe support surface, the hinge including further a sash arm attachable to a window sash and a guide arm pivotably attached at one end to the track and at the other end to the sash arm, the shoe comprising:

a sole plate having a first side sized to fit adjacent to the shoe support surface and having a pivot pivotably receiving one end of the sash arm;

a rail extending perpendicularly from the sole plate to fit within the channel when the first side of the sole plate is adjacent to the shoe support surface, the rail attached at a first end through a fulcrum to the sole plate in cantilevered fashion; and a wedge movably attached to the sole plate and the rail and positioned between the fulcrum and a second end of the rail to bend the rail outward from the sole plate thereby reducing clearance between the rail and the channel when the rail is so installed in the channel.

2. The adjustable shoe of claim 1 wherein the wedge is a tapered screw received in an aperture having one wall on the sole plate and an opposed second wall on the rail.

3. The adjustable shoe of claim 2 wherein the aperture is tapered to conform to the wedge.

4. The adjustable shoe of claim 1 wherein the wedge is positioned at a longitudinal end of the shoe opposite the pivot point.

5. The adjustable shoe of claim 1 wherein the sole plate incorporates a metal sheet core having an upward fold in a transverse edge forming the rail.

6. The adjustable shoe of claim 5 wherein the metal sheet has an outer coating of thermoplastic material.

7. The adjustable shoe of claim 1 further includes at least two longitudinal runners extending from the first side toward the shoe support surface.

* * * * *